US008461954B2

(12) United States Patent
Asakura

(10) Patent No.: US 8,461,954 B2
(45) Date of Patent: Jun. 11, 2013

(54) REACTOR-SECURING STRUCTURE

(75) Inventor: Ken Asakura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/501,153

(22) PCT Filed: Nov. 26, 2009

(86) PCT No.: PCT/JP2009/069964

§ 371 (c)(1),
(2), (4) Date: Apr. 10, 2012

(87) PCT Pub. No.: WO2011/064863

PCT Pub. Date: Jun. 3, 2011

(65) Prior Publication Data

US 2012/0223794 A1 Sep. 6, 2012

(51) Int. Cl.

| | |
|---|---|
| ***H01F 27/06*** | (2006.01) |
| ***H01F 27/02*** | (2006.01) |
| ***H01F 17/06*** | (2006.01) |
| ***H01F 27/30*** | (2006.01) |
| ***H01F 17/04*** | (2006.01) |

(52) U.S. Cl.
USPC ..... 336/65; 336/66; 336/67; 336/68; 336/90; 336/178; 336/197; 336/221

(58) Field of Classification Search
USPC ..... 336/65, 66, 67, 68, 90, 178, 197, 336/221
See application file for complete search history.

(56) References Cited

U.S. PATENT DOCUMENTS

| | | | | |
|---|---|---|---|---|
| 6,593,836 | B1 * | 7/2003 | LaFleur et al. | 336/61 |
| 6,856,229 | B2 * | 2/2005 | Ogawa et al. | 336/200 |
| 8,035,469 | B2 * | 10/2011 | Okamoto et al. | 336/65 |
| 2002/0014941 | A1 * | 2/2002 | Yoshioka et al. | 336/184 |
| 2009/0108971 | A1 * | 4/2009 | Okamoto | 336/65 |
| 2011/0156853 | A1 * | 6/2011 | Kato et al. | 336/192 |
| 2012/0011033 | A1 * | 1/2012 | Salgia | 705/27.2 |

FOREIGN PATENT DOCUMENTS

| | | |
|---|---|---|
| JP | U-53-119841 | 9/1978 |
| JP | 2004241475 A * | 8/2004 |
| JP | A-2004-241475 | 8/2004 |
| JP | A-2007-180140 | 7/2007 |

(Continued)

OTHER PUBLICATIONS

International Search Report issued in International Patent Application No. PCT/JP2009/069964 dated Feb. 16, 2010.

*Primary Examiner* — Mohamad Musleh
*Assistant Examiner* — Kazi Hossain
(74) *Attorney, Agent, or Firm* — Oliff & Berridge, PLC

(57) ABSTRACT

A reactor-securing structure includes, one end of a first-side stay and one end of a second-side stay that are connected to portions of a reactor which are separated from each other at the two sides of a coil axial direction. The other end of the first-side stay and the other end of the second-side stay are fastened in states overlapping the inverter case. A first-side overlapping portion is formed by having the other end of the first-side stay overlap the inverter case, and a second-side overlapping portion is formed by having the other end of the second-side stay overlap the inverter case. A portion of the first-side overlapping portion and a portion of the second-side overlapping portion, when seen from a plan view, are provided in the same range relating to the length direction of the I-shaped section forming the reactor.

4 Claims, 10 Drawing Sheets

FOREIGN PATENT DOCUMENTS

| | | | |
|---|---|---|---|
| JP | A-2008-117898 | | 5/2008 |
| JP | A-2009-26952 | | 2/2009 |
| JP | A-2009-99793 | | 5/2009 |
| JP | A-2009-272508 | | 11/2009 |
| WO | WO 2008/093492 | A1 | 8/2008 |
| WO | WO 2008093492 | A1 * | 8/2008 |

* cited by examiner (a)

(b)

REACTOR-SECURING STRUCTURE

TECHNICAL FIELD

The present invention relates to a reactor-securing structure including a reactor including a core member having a coil wound thereon, and a first-side stay and a second-side stay, with the reactor being fixed to a case by the first-side stay and the second-side stay.

BACKGROUND ART

In the related art, for example, in a vehicle having a rotary-electric machine such as an electric automotive vehicle or a hybrid car, there is contemplated provision of an inverter and a booster circuit between the rotary-electric machine and a power supply device such as a secondary cell to constitute a rotary-electric machine driving apparatus. The booster circuit includes a switching element and a reactor connected to the switching element, and the reactor includes a core formed of a magnetic material such as an iron core and a coil wound around the core. The booster circuit is capable of controlling power accumulation in the reactor by controlling an ON time and an OFF time of the switching element, increasing the voltage supplied from the power source to an arbitrary voltage, and supplying the same to the inverter.

Patent Document 1 describes a reactor core, having a coil, to be stored and fixed in a housing in a certain posture, and a sealing resin member formed by filling a silicone resin into the housing and hardening it. In this reactor, a reactor core is stored and fixed in a housing formed of aluminum via a fixing member.

CITED REFERENCE

Patent Document

Patent Document 1: JP-A-2009-99793

SUMMARY OF INVENTION

Problems to be Solved by the Invention

In the case of a securing structure of the reactor core with respect to the housing described in Patent Document 1, there is a probability that the temperature of the reactor is increased by application of a current to a coil or the like, and the housing serving as a case and the reactor core both undergo thermally expansion. However, the housing is formed of aluminum, while the reactor core is formed of a magnetic material such as iron, so that the linear expansion coefficients of the housing and the reactor core are different. Accordingly, due to the difference in linear expansion coefficient, separation may occur at gap-bonding portions between two segment cores which constitute the reactor core, and a gap plate fixedly bonded between two segment cores.

For example, in a case where the housing is formed of aluminum and the reactor core is formed of iron, upon temperature increase, the housing is significantly expanded whereas the amount of expansion of the reactor is small. Therefore, when the reactor is fixed to the housing with fixing members provided on both sides of the reactor core without special considerations, at the time of temperature increase a tensile force is imposed by the housing to the reactor core via the fixing members. Therefore, when the adhesive force at the gap-bonding portions between the segment cores and the gap plate is small, it cannot be said that there is no possibility of occurrence of separation at the gap-bonding portions.

An object of the present invention is to prevent generation of an excessive tensile force from a case to a reactor in a reactor-securing structure at the time of temperature increase even when there is a linear expansion difference between the case and a constituting component of the reactor.

Means for Solving the Problems

A reactor-securing structure according to the present invention is a reactor-securing structure including: a reactor including a core member having a coil wound thereon; and a first-side stay and a second-side stay, the first-side stay and the second-side stay fixing the reactor to a case, wherein one-end portions of the first-side stay and the second-side stay are coupled to portions of the reactor shifted toward respective sides in the axial direction thereof, the other end portion of the first-side stay and the other end portion of the second-side stay are fastened and coupled to the case in a state of overlapping each other directly or via another member, the other end portion of the first-side stay overlaps an opponent member to constitute a first-side overlapping portion, the other end portion of the second-side stay overlaps an opponent member to constitute a second-side overlapping portion, and at least parts of the first-side overlapping portion and the second-side overlapping portion when viewed in a direction orthogonal to overlapping surfaces of the first-side overlapping portion and the second-side overlapping portion are provided within the same range in the longitudinal direction of the I-shaped portion which forms the core member and the coil is wound on.

According to the reactor-securing structure described above, by fastening and coupling the stays at appropriate positions within the same range portion of the respective overlapping portions in the longitudinal direction of the I-shaped portion, generation of an excessive tensile force from the case to the reactor at the time of temperature rise can be prevented even when there is a linear expansion difference between the case and a constituting component of the reactor. Therefore, even when the reactor includes a plurality of segment cores and the gap plate fixedly bonded between the respective segment cores, separation at the gap-bonding portions between the segment cores and the gap plate is effectively prevented.

In the reactor-securing structure according to the present invention, preferably, a first fastening portion which couples the first-side overlapping portion and the case is provided on one-end coupling side of the second-side stay in the I-shaped portion, and a second fastening portion which couples the second-side overlapping portion and the case is provided on one-end coupling side of the first-side stay in the I-shaped portion.

In this configuration, when the linear expansion coefficient of the case is larger than the linear expansion coefficient of the component of the reactor, a compressive force can be applied from the case to the reactor at the time of temperature rise, so that generation of the excessive tensile force in the reactor can be prevented further effectively.

In the reactor-securing structure according to the present invention, preferably, the first fastening portion which couples the first-side overlapping portion and the case and the second fastening portion which couples the second-side overlapping portion and the case are configured with a common fastening portion.

In this configuration, generation of an excessive tensile force in the reactor is effectively prevented in both temperature rise and temperature drop, and cost reduction is also achieved.

In the reactor-securing structure according to the present invention, preferably, the case is an inverter case configured to store and fix an inverter and the reactor therein.

Advantages of the Invention

According to the reactor-securing structure of the present invention, generation of excessive tensile force from the case to the reactor at the time of temperature increase is prevented even when there is a linear expansion difference between the case and a constituting component of the reactor.

BEST MODES FOR CARRYING OUT THE INVENTION

First Embodiment of the Invention

Figure 1:
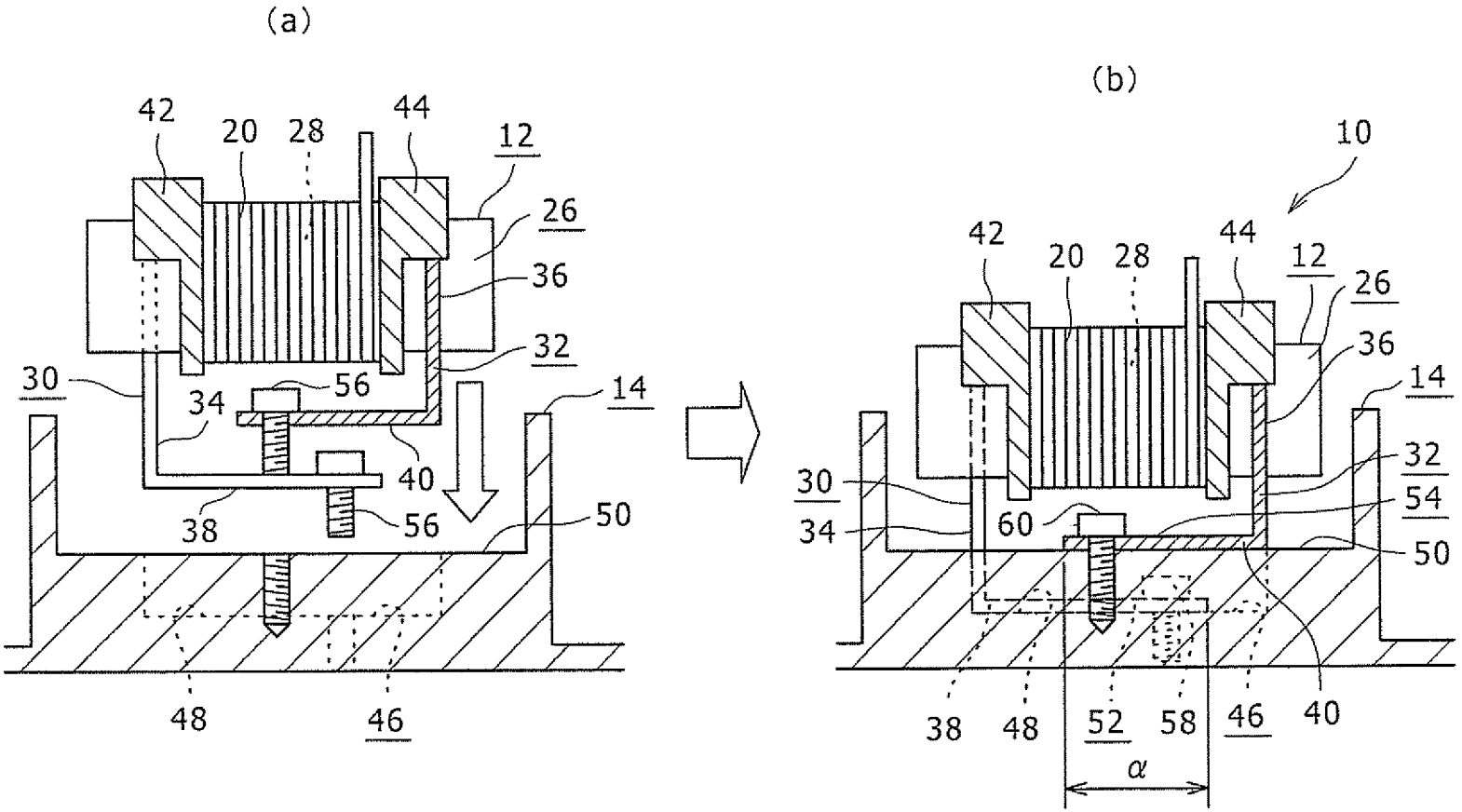
FIG. 1 is a cross-sectional view of a reactor-securing structure according to a first embodiment of the present invention, in which (a) shows a state before the reactor is fixed to the case, and (b) shows a state after the reactor is fixed to the case.

Referring now to FIG. 1 to FIG. 6, a first embodiment of the invention will be described. As shown in FIG. 1(*b*), a reactor-securing structure 10 of the present embodiment is a so-called float-type reactor supporting structure, and the reactor is fixed to a case in a state in which a bottom surface of the reactor is apart from the upper surface of the case. In this regard, however, the reactor can be fixed to the case in a state in which the bottom surface of the reactor is in abutment with the upper surface of the case. Also, a space between the case and the reactor may be filled with a resin.

The reactor-securing structure 10 includes a reactor 12 and an inverter case 14. The reactor 12 includes a core body 16 shown in FIG. 6, described later, and a coil 20 wound around the core body 16 via a resin portion 18. The core body 16 is configured in such a manner that both end portions of two segment cores 22 (FIG. 6) each having a U-shape are fixedly coupled to each other via a non-magnetic gap plate 24 (FIG. 6) in plan view when viewed downward from above in FIG. 1 and FIG. 6. The gap plate 24 is formed of, for example, ceramics or a resin. In other words, one-end portions of the two segment cores 22 are fixed by bonding with an adhesive agent applied on both surfaces of the gap plate 24, and the other-end portions of the two segment cores 22 are fixed by bonding with the adhesive agent applied to both surfaces of another gap plate (not shown). Then, the entire core body 16 is formed into an annular shape. The respective segment cores 22 are formed of compressed powder magnetic cores formed by compressing and shaping powder of metal such as iron or powder of a soft magnetic material of metallic oxide. However, the respective segment cores 22 may be formed of a laminated body including a plurality of laminated magnetic metal plates such as magnetoelectric steel plates. Also, the core body 16 is molded so as to be covered entirely with the resin portion 18 to thereby form a resin-integrated core 26, which is an annular core member as a whole.

Figure 2:
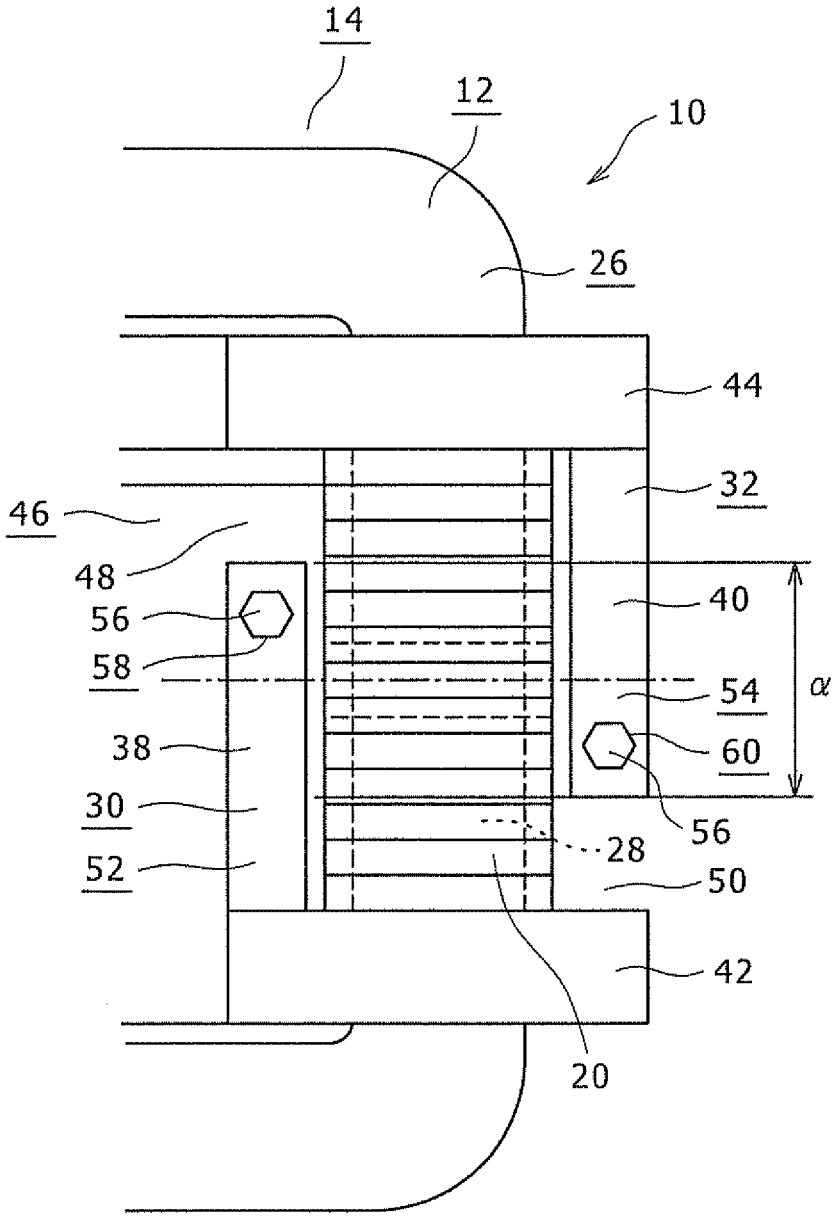
FIG. 2 is a drawing wherein part of the reactor-securing structure in the first embodiment is viewed downward from above.

Also, as shown in FIG. 1 and FIG. 2, I-shaped portions 28 which forms the resin-integrated core 26 and the coils 20 are wound on, are provided at two positions on respective sides in the width direction of the resin-integrated core 26 (the front-back direction in FIG. 1 the lateral direction in FIG. 2) (only one of the I-shaped portions 28 is shown in FIG. 2), and one-ends of the coils 20 are connected to each other. A first-side stay 30 and a second-side stay 32 are each fixed to two positions shifted to respective sides of the respective coils 20 of the resin-integrated core 26 in the axial direction; that is, to four positions in total.

As shown in FIG. 1(*a*), the first-side stay 30 and the second-side stay 32 are formed by bending metal plates into an L-shape in cross section, and have upright plate portions 34, 36 and horizontal plate portions 38, 40, respectively. Also, in the resin-integrated core 26, fixing portions 42, 44 are integrally formed at two positions shifted to respective sides of the coils 20 in the axial direction; that is, at four positions in total, and the first-side stay 30 or the second-side stay 32 is fixed to each of the fixing portions 42, 44. In other words, in the resin-integrated core 26, one end portion (upper end portion in FIG. 1) of the upright plate portion 34 of the first-side stay 30 is coupled to the first-side fixing portion 42 provided on a portion shifted to one side (left side in FIG. 1) of the coil 20 in the axial direction. Also, in the resin-integrated core 26, the one end portion of the upright plate portion 36 of the second-side stay 32 is coupled to the second-side fixing portion 44 provided on a portion shifted to the other side (right side in FIG. 1) of the coil 20 in the axial direction. Also, the first-side stay 30 and the second-side stay 32 are provided at positions shifted to respective sides in the width direction (lateral direction in FIG. 2) with respect to the resin-integrated core 26 as shown in FIG. 2. In other words, the first-side stay 30 is provided at a position closer to the center of the reactor 12 in the width direction and the second-side stay 32 is provided on the outer side of the reactor 12 in the width direction.

The horizontal plate portions 38, 40 of the respective stays 30, 32 are extended horizontally toward each other in the axial direction of the coil 20 and, as shown in FIG. 1(*b*) and FIG. 2, distal end portions of the horizontal plate portions 38, 40, which are the other-end portions of the respective stays 30, 32, overlap the upper surface of the inverter case 14. The inverter case 14 is formed of aluminum alloy. The inverter case 14 fixedly stores an inverter, not shown, and the reactor 12. The case in which the reactor 12 is fixed is not limited to the inverter case 14 as in this example, and, a case in which only the reactor 12, for example, is fixedly stored is also applicable.

Also, the inverter case 14 is provided with a depression 46 depressed downward with respect to both sides in the width direction at the center in the width direction. In the inverter case 14, the horizontal plate portion 38 of the first-side stay 30 overlaps a first mounting surface 48, which is a bottom surface of the depression 46 in the horizontal direction and, in the inverter case 14, the horizontal plate portion 40 of the second-side stay 32 overlaps a second mounting surface 50 provided at position higher than the bottom surface of the depression 46 in the horizontal direction.

The distal end portion of the horizontal plate portion 38 of the one-side stay 30 overlaps the first mounting surface 48 of the inverter case 14 as an opposite member to form a first-side overlapping portion 52. Also, the distal end portion of the horizontal plate portion 40 of the second-side stay 32 overlaps the second mounting surface 50 of the inverter case 14 to form a second-side overlapping portion 54. Parts of the first-side overlapping portion 52 and the second-side overlapping portion 54 are provided in the same range (the range indicted by an arrow $\alpha$ in FIG. 1(*b*) and FIG. 2) in the longitudinal direction (the lateral direction in FIG. 1, the vertical direction in FIG. 2) of the I-shaped portion 28 having the coil 20 wound thereon when viewed in the direction orthogonal to the overlapped surface of the first-side overlapping portion 52 and the second-side overlapping portion 54; that is, when viewed in the up-down direction in FIG. 1, or the front-back direction in FIG. 2, in a plan view.

Then, bolts 56 inserted into the horizontal plate portions 38, 40 are fastened and coupled into screw holes provided on first mounting surface 48 and the second mounting surface 50 with the distal end portions of the horizontal plate portions 38, 40 of the respective stays 30, 32 directly overlapping the upper surface of the inverter case 14. In this case, a first fastening portion 58 serving as a fastening portion of the bolt 56 which couples the first-side overlapping portion 52 and the inverter case 14 is provided on one-end coupling side (the right side in FIG. 1, the upper side in FIG. 2) of the second-side stay 32 in the longitudinal direction of the I-shaped portion 28. Also, a second fastening portion 60 serving as a fastening portion of the bolt 56 which couples the second-side overlapping portion 54 and the inverter case 14 is provided on one-end coupling side (the left side in FIG. 1, the lower side in FIG. 2) of the first-side stay 30 in the longitudinal direction of the I-shaped portion 28.

Figure 3:
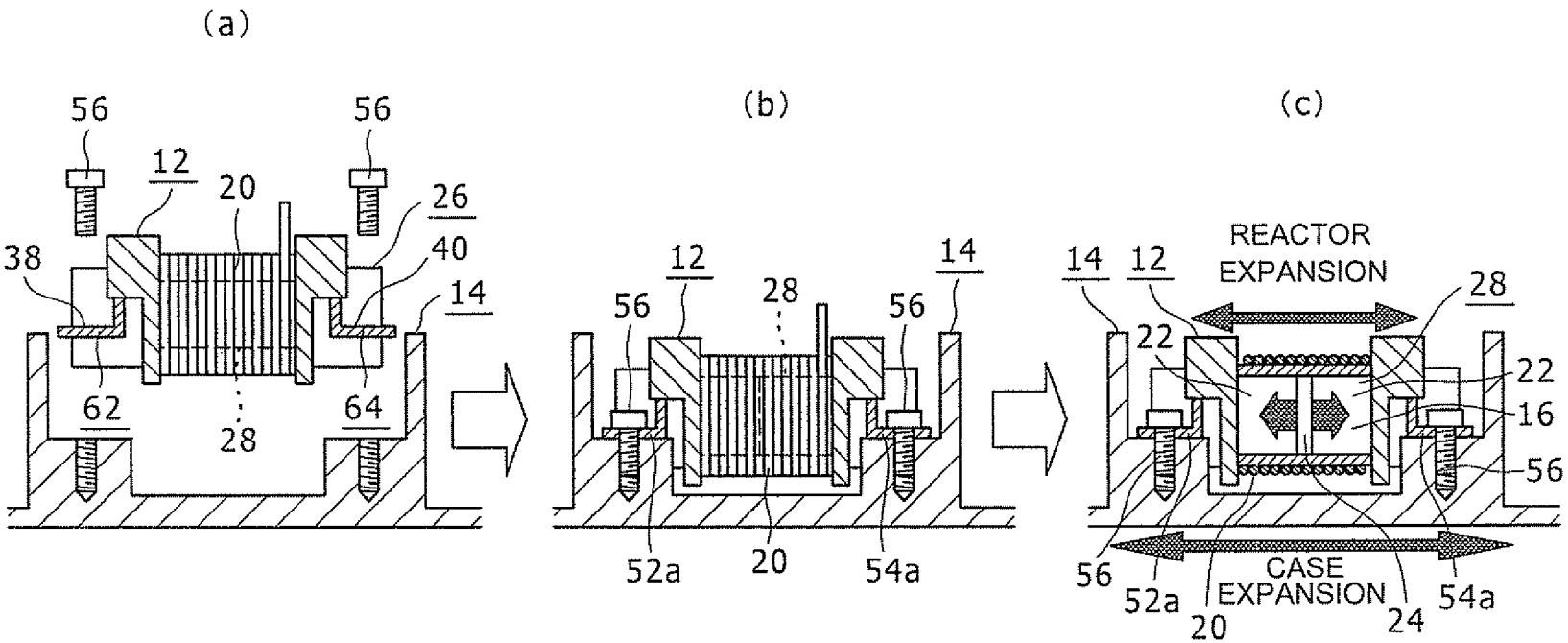
FIG. 3 is a cross-sectional view of a reactor-securing structure of the related art, in which (a) shows a state before a reactor is fixed to a case, (b) shows a state after the reactor is fixed to the case, and (c) shows a state in which stress is applied to respective parts at the time of temperature increase.
Figure 4:
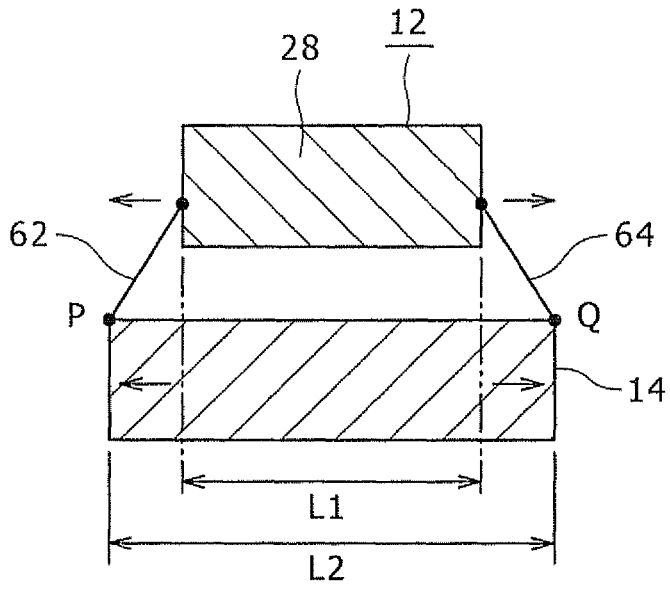
FIG. 4 is a schematic drawing of a reactor-securing structure of the related art, showing a state in which a stress is applied to a reactor and a case at the time of temperature increase.

According to the reactor-securing structure 10 configured in this manner, generation of an excessive tensile force from the inverter case 14 to the reactor 12 is prevented even when there is a linear expansion difference between the inverter case 14 and a constituting component of the reactor 12. Prior to the description thereof, disadvantages of the reactor-securing structure of the related art will be described. FIG. 3 is a cross-sectional view of reactor-securing structure of the related art, in which (a) shows a state before a reactor 12 is fixed to an inverter case 14, (b) shows a state after the reactor 12 is fixed to the inverter case 14, and (c) shows a state in which a stress is applied to each part at the time of temperature increase. FIG. 4 is a schematic drawing of the reactor-securing structure of the related art, showing a state in which a stress is applied to the reactor 12 and the inverter case 14 at the time of temperature increase.

As shown in FIG. 3, in the reactor-securing structure of the related art, the reactor 12 is fixed to the inverter case 14 formed of aluminum alloy. As shown in FIG. 3(*a*), in a resin-integrated core 26 formed by molding the core body with a resin, a first-side stay 62 and a second-side stay 64 each having an L-shape in cross section are coupled to portions shifted to respective sides of an I-shaped portion 28 having a coil 20 wound thereon in the axial direction.

Horizontal plate portions 38, 40 extending in the horizontal direction of the respective stays 62, 64 extend in the direction away from the I-shaped portion 28. As shown in FIG. 3(*b*), the reactor 12 is fastened and coupled to the inverter case 14 by fastening bolts 56 into the respective stays 62, 64. In the case of the structure of the related art, a first-side overlapping portion 52*a* which is an overlapping portion between the first-side stay 62 and the inverter case 14 and a second-side overlapping portion 54*a* which is an overlapping portion between the second-side stay 64 and the inverter case 14 are provided in a range shifted in the longitudinal direction of the I-shaped portion 28. Also, the linear expansion coefficient of a core body 16 (FIG. 3(*c*)) which constitutes the reactor 12 is smaller than the linear expansion coefficient of the inverter case 14. In FIG. 3(*a*), (*b*), the reactor 12 and the inverter case 14 are both at normal temperature.

In the case of the structure of the related art, as shown in FIG. 3(*c*), at the time of temperature rise the amount of the thermal expansion of the inverter case 14 is large and the amount of thermal expansion of the core body 16 is small because of the difference in linear expansion coefficient. For example, when the temperatures of the reactor 12 and the inverter case 14 are increased to a level higher than normal temperature, the expansion of the inverter case 14 is larger than the expansion between the coupled portions of the two stays 62, 64 on respective sides of the coil 20 of the resin-integrated core 26. Therefore, a force in the direction of tension is applied to the reactor 12 from the inverter case 14 via the stays 62, 64. In this case, when portions between two segment cores 22 and a gap plate 24 are bonded by gap-bonding portions in the I-shaped portion 28 which constitutes the reactor 12, if the bonding force is small, it cannot be said that there is no probability of occurrence of separation at the gap-bonding portions.

In other words, as shown in a schematic drawing in FIG. 4, when the length between two points P, Q of the inverter case 14 is expanded from L1 to L2 due to the temperature rise, the reactor 12 is pulled in the longitudinal direction of the I-shaped portion 28 by the stays 62, 64 connected to the points P and Q. Therefore, it cannot be said that there is no possibility that a large tensile force is applied.

Figure 5:
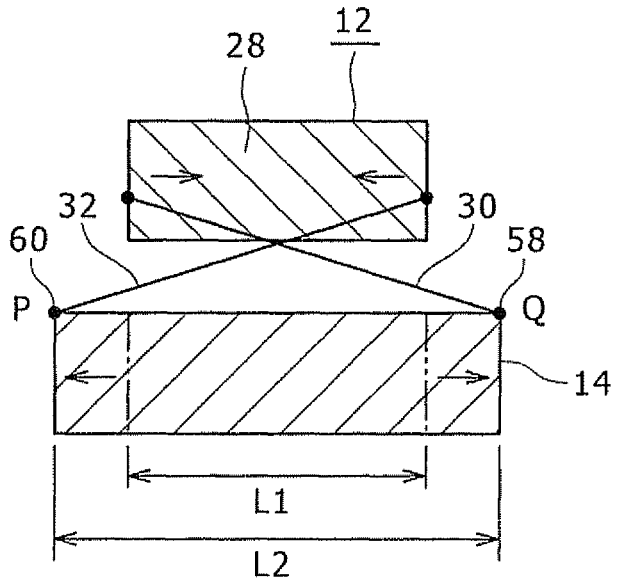
FIG. 5 is a schematic drawing showing a state in which a stress is applied to the reactor and the case at the time of temperature increase in the reactor-securing structure according to the first embodiment.

In contrast, in the present example, as shown in the schematic drawing in FIG. 5, the first fastening portion 58 which couples the first-side stay 30 and the inverter case 14 is provided on one-end coupling side (the right side in FIG. 5) of the second-side stay 32 in the longitudinal direction of the I-shaped portion 28, and the second fastening portion 60 which couples the second-side stay 32 and the inverter case 14 is provided on one-end coupling side (left side in FIG. 5) of the first-side stay 30 in the longitudinal direction of the I-shaped portion 28. Therefore, when the length between the two points P, Q of the inverter case 14 is expanded from L1 to L2 due to the temperature rise, a force of compression in the longitudinal direction of the I-shaped portion 28 is applied to the reactor 12 by the stays 30, 32 connected to the points P and Q. In this manner, when the linear expansion coefficient of the inverter case 14 is larger than the linear expansion coefficient of the components of the reactor 12, the force in the direction of compression can be applied from the inverter case 14 to the reactor 12 at the time of temperature rise, so that generation of the excessive tensile force in the reactor 12 can be prevented further effectively.

Figure 6:
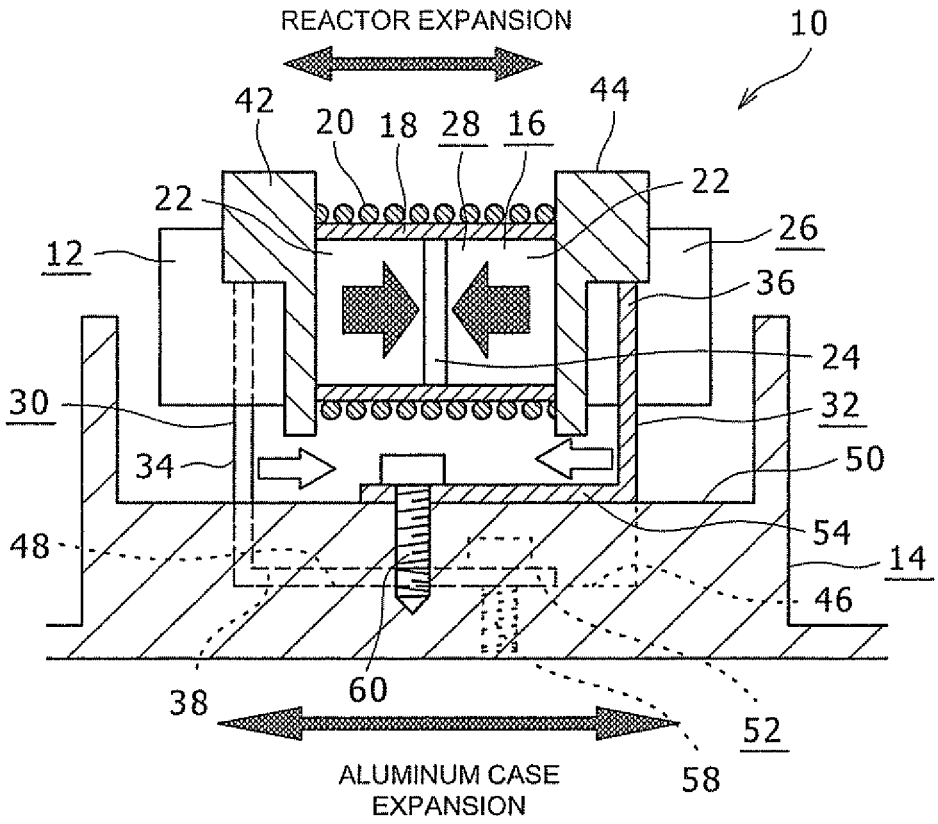
FIG. 6 is a cross-sectional view corresponding to FIG. 1(*b*), showing a state in which a stress is applied to respective parts at the time of temperature increase in the reactor-securing structure according to the first embodiment.

Referring now to FIG. 6, further detailed description will be given below. In this example, parts of the first-side overlapping portion 52 and the second-side overlapping portion 54 are provided in the same range in the longitudinal direction of the I-shaped portion 28. Therefore, by fastening and coupling the stays 30, 32 at appropriate positions within the same range portion of the respective overlapping portions 52, 54 in the longitudinal direction of the I-shaped portion 28, generation of an excessive tensile force from the inverter case 14 to the reactor 12 at the time of temperature rise is prevented even when there is a linear expansion difference between the inverter case 14 and a constituting component of the reactor 12.

In particular, in this example, the first fastening portion 58 is provided on one-end coupling side of the second-side stay 32 in the axial direction of the coil 20, and the second fastening portion 60 which couples the second-side overlapping portion 54 and the inverter case 14 is provided on one-end coupling side of the first-side stay 30 in the axial direction of the coil 20. Therefore, when the inverter case 14 is formed of aluminum alloy, part of the core body 16 is formed of a metal such as iron, and the linear expansion coefficient of the inverter case 14 is larger than the linear expansion coefficient of the constituting component of the reactor 12, even though the inverter case 14 and the reactor 12 are thermally expanded by different amounts of expansion at the time of temperature rise due to a power distribution to the coil 20, the ends of the first-side stay 30 and the second-side stay 32 on the side fixed to the reactor 12 tend to approach, so that a force in the direction of compression is applied to the reactor 12. Therefore, generation of an excessive tensile force from the inverter case 14 to the reactor 12 is prevented. In this case, a compression load in the direction opposite the direction of expansion of the inverter case 14 is applied to the reactor 12. Therefore, as in this example, even when the reactor 12 includes a plurality of segment cores 22 and the gap plate 24 fixedly bonded between the respective segment cores 22, separation at the gap-bonding portions between the segment cores 22 and the gap plate 24 is effectively prevented.

In the case of this example, the inverter case 14 is formed of aluminum alloy. However, the inverter case 14 may be formed of a metal having a linear expansion coefficient larger than that of the material of the constituting component of the reactor 12 instead of aluminum alloy. Also, the first-side stay 30 and the second-side stay 32 provided on respective sides of the coil 20 of the I-shaped portion 28 may be provided on the same side with respect to the coil 20 in plan view instead of the positions shifted to the respective sides of the coil 20 in plan view. Also, by providing mounting surfaces for the stays 30, 32 at the same position in plan view of the inverter case 14 and at different positions in the vertical direction, at least parts of the first-side overlapping portion 52 and the second-side overlapping portion 54 may be provided so as to overlap in plan view.

Figure 7:
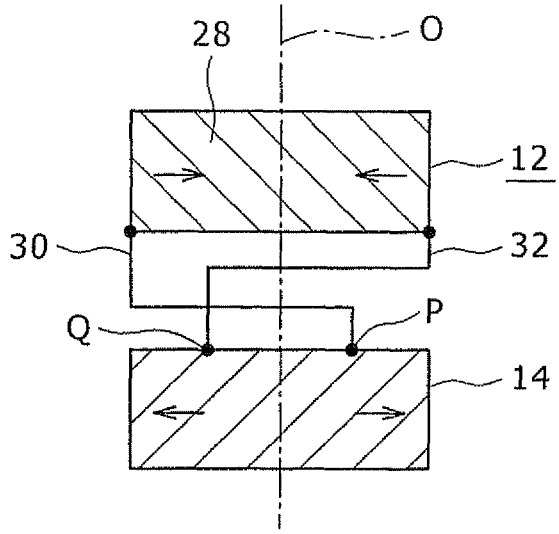
FIG. 7 is a schematic drawing showing two examples in which the positions of attachment of a first-side stay and a second-side stay with respect to the case are different in the reactor-securing structure according to the first embodiment.
Figure 7:
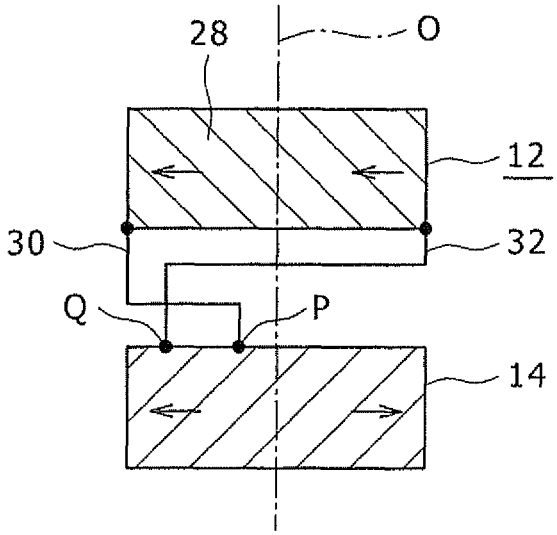

FIG. 7 is a schematic drawing showing two examples in which the positions of attachment of the first-side stay 30 and the second-side stay 32 are different with respect to the inverter case 14 in the reactor-securing structure according to the first embodiment. In FIG. 7(*a*), a first fastening portion P of the first-side stay 30 with the inverter case 14 and a second fastening portion Q of the second-side stay 32 with the inverter case 14 are arranged on respective sides of the inverter case 14 with respect to a center O in the longitudinal direction (the lateral direction in FIG. 7(*a*)). In FIG. 7(*b*), the first fastening portion P of the first-side stay 30 with the inverter case 14 and the second fastening portion Q of the second-side stay 32 with the inverter case 14 are arranged on only one side of the inverter case 14 with respect to the center O in the longitudinal direction (the lateral direction in FIG. 7(*b*)). In this manner, in the first embodiment, the fastening portions may be provided at different positions with respect to the center O of the inverter case 14 in the longitudinal direction. However, in the case of FIG. 7(*b*), if the distance between P and Q is increased at the time of temperature rise, forces different in magnitude and in the same longitudinal direction of the I-shaped portion 28 are applied; the force in the direction of compression is applied to the reactor 12, but the magnitude thereof may be reduced. In contrast, in the case shown in FIG. 7(*a*), a force is applied in the opposite direction in the longitudinal direction of the I-shaped portion 28 and hence is compressed at the time of temperature rise, so that a large force in the direction of compression can easily be applied to the reactor 12.

Second Embodiment of the Invention

Figure 8:
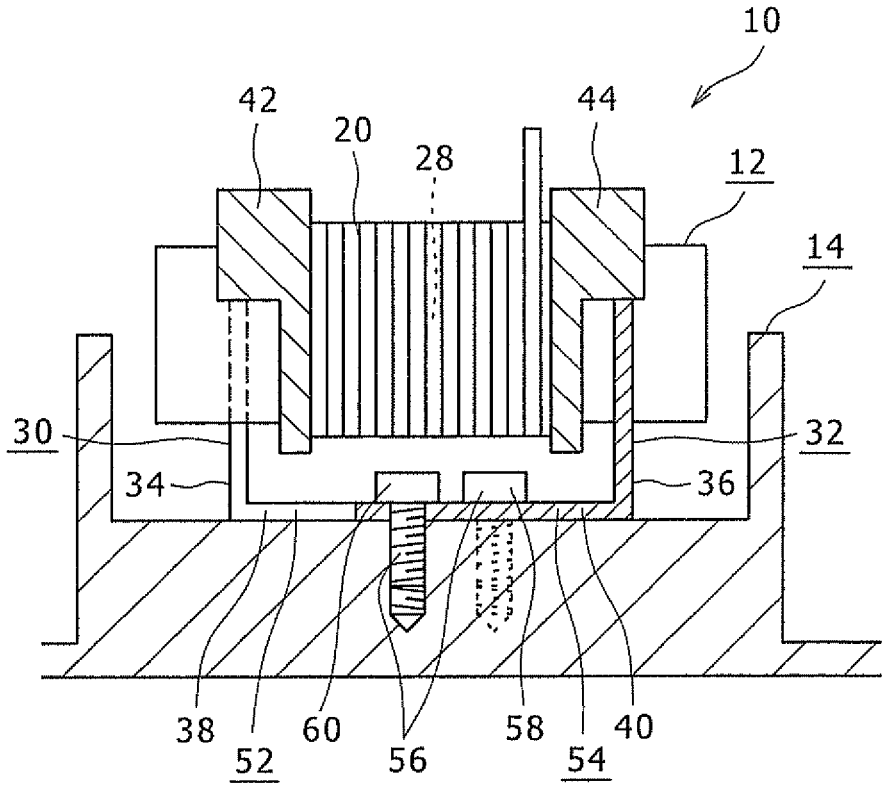
FIG. 8 is a cross-sectional view showing a reactor-securing structure according to a second embodiment of the present invention.

FIG. 8 is a cross-sectional view showing a reactor-securing structure 10 according to a second embodiment of the present invention. In this example, in terms of the first embodiment described above, the first-side overlapping portion 52 between the first-side stay 30 and the inverter case 14 is provided at the same position as the second-side overlapping portion 54 between the second-side stay 32 and the inverter case 14 in the vertical direction and shifted therefrom in the direction of the width of the reactor 12 (the front and back direction in FIG. 8). Then, the first fastening portion 58 which couples the first-side overlapping portion 52 and the inverter case 14 is provided on the one-end coupling side (the right side in FIG. 8) of the second-side stay 32 in the longitudinal direction of the I-shaped portion 28 which constitutes the reactor 12 and the coil 20 is wound on. Also, the second fastening portion 60 which couples the second-side overlapping portion 54 and the inverter case 14 is provided on one-end coupling side (the left side in FIG. 8) of the first-side stay 30 in the longitudinal direction of the I-shaped portion 28. Other configurations and advantages are similar to those in the first embodiment described above.

Third Embodiment of the Invention

Figure 9:
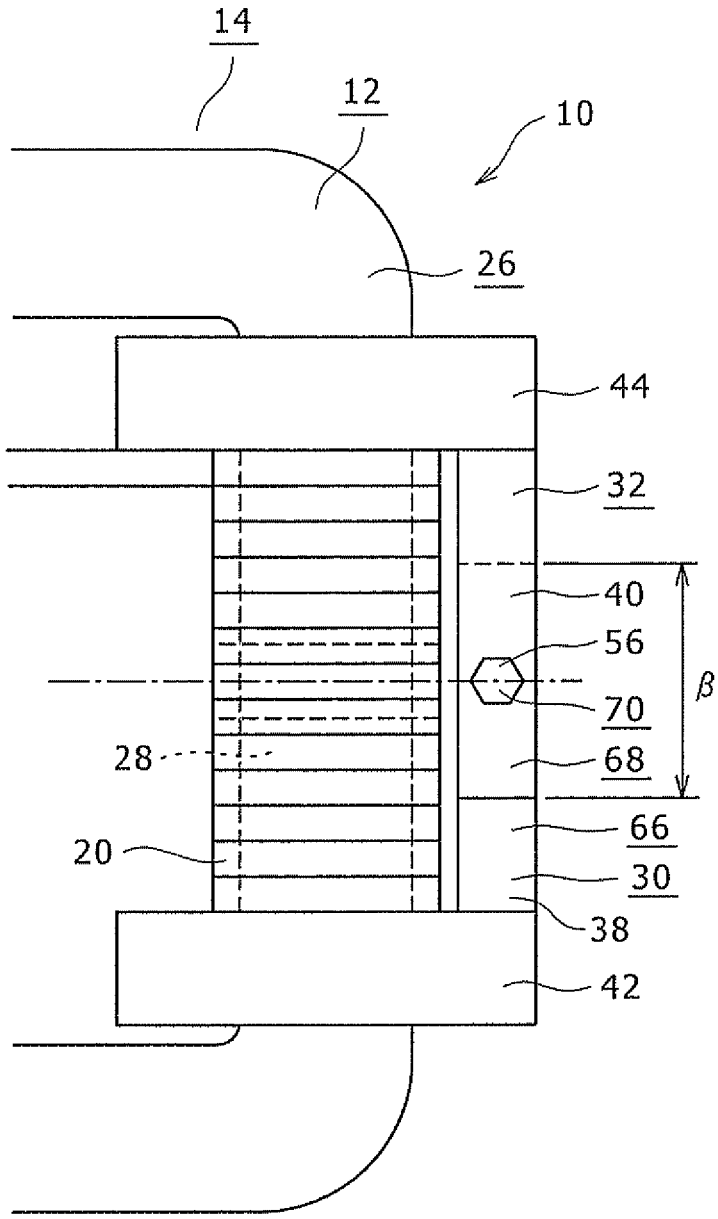
FIG. 9 is a drawing wherein part of a reactor-securing structure of a third embodiment of the present invention is viewed downward from above.
Figure 10:
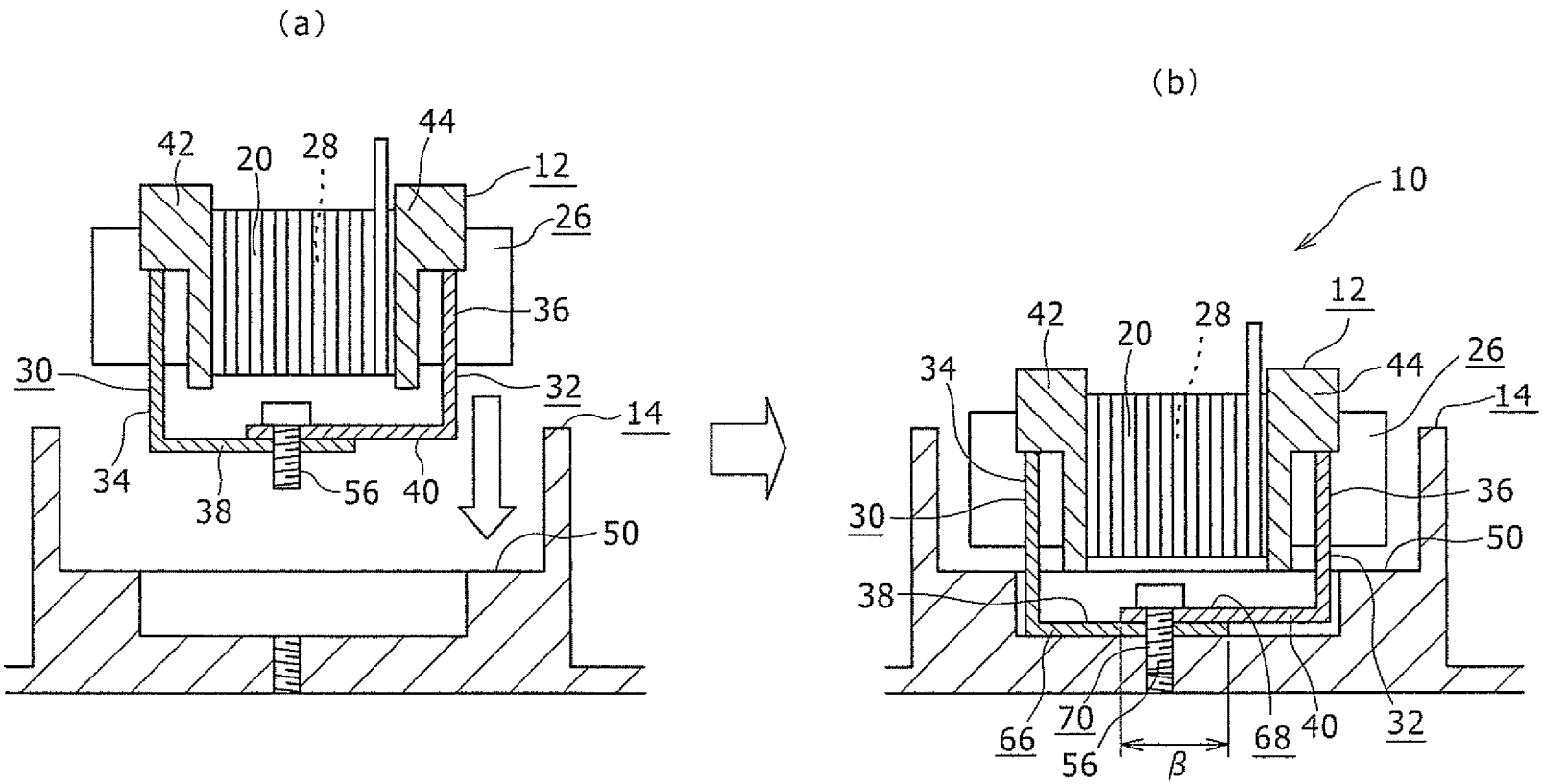
FIG. 10 is a cross-sectional view of a reactor-securing structure according to the third embodiment, in which (a) shows a state before a reactor is fixed to a case, and (b) shows a state after the reactor is fixed to the case.
Figure 11:
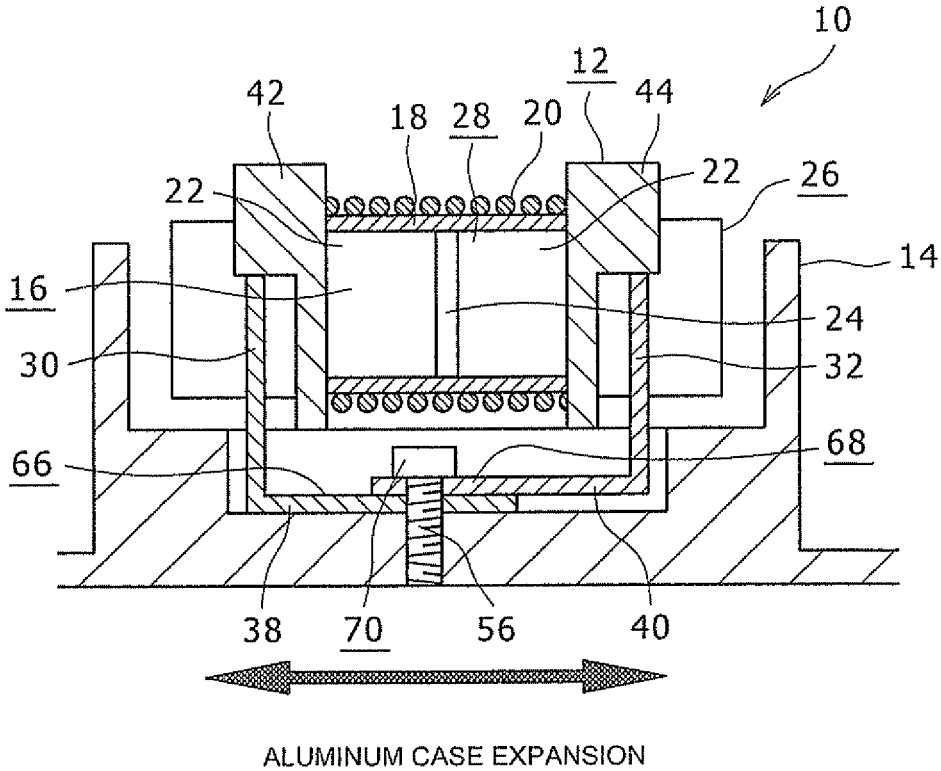
FIG. 11 is a cross-sectional view corresponding to FIG. 10(*b*), showing a state in which stress is applied to respective parts at the time of temperature increase in the reactor-securing structure according to the third embodiment.

FIG. 9 is a drawing of part of the reactor-securing structure 10 according to a third embodiment of the present invention viewed downward from above. FIG. 10 is a cross-sectional view of a reactor-securing structure 10 according to the third embodiment, in which (a) shows a state before the reactor 12 is fixed to the inverter case 14, and (b) shows a state after the reactor 12 is fixed to the inverter case 14. FIG. 11 is a cross-sectional view corresponding to FIG. 10(*b*), showing a state in which a stress is applied to respective parts at the time of temperature increase in the reactor-securing structure according to the third embodiment.

In this example, as shown in FIGS. 9, 10(*a*), and 10(*b*), one-end portions of the first-side stay 30 and the second-side stay 32 are coupled to one side (the right side in FIG. 9) in the direction of the width of the coil 20 of the reactor 12 at portions shifted to the respective sides in the axial direction of the coil 20 (the vertical direction in FIG. 9, lateral directions in FIGS. 10(*a*) and (*b*)). Also, the horizontal plate portion 38, which is the other portion of the first-side stay 30, overlaps the upper surface of the inverter case 14, so that a first-side overlapping portion 66 is formed. Also, the horizontal plate portion 40, which is the other end portion of the second-side stay 32, overlaps the upper surface of the horizontal plate portion 38 of the first-side stay 30, so that a second-side overlapping portion 68 is formed.

Then, parts of the first-side overlapping portion 66 and second-side overlapping surface 68 are provided in the same range (the range indicted by an arrow β in FIG. 9 and FIG. 10(*b*)) of the I-shaped portion 28 which constitutes the reactor 12 in the longitudinal direction (the vertical direction in FIG. 9, the lateral direction in FIGS. 10(*a*) (*b*)) when viewed in the direction orthogonal to the overlapped surface of the first-side overlapping portion 66 and the second-side overlapping portion 68 (the front-back direction in FIG. 9, the up-down direction in FIGS. 10(*a*) and (*b*)). For reference, the one-end portions of the first-side stay 30 and the second-side stay 32 may be coupled to the reactor 12 at other portions such as the other side (the left side in FIG. 9) with respect to the coil 20 of the reactor 12 in the direction of the width.

Then, the bolt 56 is inserted into holes provided at positions aligned in a state in which the first-side stay 30 and the second-side stay 32 are overlapped with each other, and is fastened and coupled into a screw hole provided on the upper surface of the inverter case 14. In other words, a first fastening portion that fastens and couples the first-side overlapping portion 66 and the inverter case 14 and a second fastening portion that fastens and couples the second-side overlapping portion 68 and the inverter case 14 are constituted by a common fastening portion 70. In other words, the first-side stay 30 and the second-side stay 32 are fastened and coupled to the inverter case 14 together.

In the case of this example, even when the inverter case 14 formed of aluminum alloy is elongated, the distance between the one-end portions of the first-side stay 30 and the second-side stay 32 coupled to respective sides of the I-shaped portion 28 does not change at the time of temperature rise shown in FIG. 11. Accordingly, the load applied to the reactor 12 from the inverter case 14 is zero. Therefore, generation of an excessive tensile force from the inverter case 14 to the reactor 12 at the time of temperature rise is prevented even when there is a linear expansion difference between the inverter case 14 and a constituting component of the reactor 12.

In addition, in the case of this example, unfavorable states which may arise in the respective embodiments described above at the time of temperature drop may be effectively prevented. In other words, referring now to FIG. 6, for example, in the case of the respective embodiments described above, the inverter case 14 having a larger linear expansion coefficient may contract by an extent larger than the reactor 12 having a smaller linear expansion coefficient at the time of temperature drop to a level lower than the normal temperature. In this case, a tensile load of some magnitude may be applied to the reactor 12 from the inverter case 14 via the respective stays 30, 32. In contrast, in the case of this example shown in FIG. 11, generation of the tensile load in the reactor 12 is prevented also at the time of temperature drop in addition to the time of temperature rise. In other words, generation of an excessive tensile force in the reactor 12 is effectively prevented in both the temperature rise and the temperature drop. In addition, the number of bolts 56 to be fastened may be reduced, and hence reduction of cost such as cost for the bolts 56 or cost for assembly may be reduced. Other configurations and advantages are similar to those in the first embodiment shown in FIG. 1 to FIG. 6 described above.

For reference, a reactor 12 fixing structure in which the entire part of the resin-integrated core 26 serving as a core member is formed into an annular shape and the two coils 20 are arranged has been described in the respective embodiments. However, the present invention does not limit the reactor to the configuration as described above, and, for example, the present invention may be applied to a structure in which the reactor is fixed to the case by the first-side stay and the second-side stay coupled to the respective end portions of the core member formed into the I-shape.

In the respective embodiments described above, one-end portions of the respective stays 30, 32 may be directly coupled to the core body 16 (see FIG. 6 and FIG. 11) instead of being coupled to the fixing portions 42, 44 formed of a resin. In other words, the respective embodiments described above may be applied to the structure in which the first-side stay and the second-side stay are coupled to the core body which is not molded with a resin directly or via the fixing portion. In this case, the core body formed into an annular shape or in an I-shape as a whole corresponds to the core member described in Claims. Also, in the reactor, it is also possible to provide the fixing portions formed of a resin or the like only on the plurality of positions of the portions shifted to respective sides of the coil and to couple one-end portions of the stays to these fixing portions.

The reactor-securing structures of the respective embodiments described above may be used by mounting on hybrid vehicles having an engine and an electric motor mounted as power sources, electric vehicles having the electric motor as a drive source, or electric vehicles such as fuel cell vehicles or the like and, in addition, the reactor-securing structures of the respective embodiments described above may be used for applications other than vehicles.

REFERENCE NUMERALS

10 reactor-securing structure
12 reactor, 14 inverter case, 16 core body
18 resin portion
20 coil
22 segment core
24 gap plate
26 resin-integrated core
28 I-shaped portion
30 first-side stay
32 second-side stay
34, 36 upright plate portion
38, 40 horizontal plate portion
42, 44 fixing portion
46 depression
48 first mounting surface
50 second mounting surface
52, 52*a* first-side overlapping portion
54 second-side overlapping portion
56 bolt
58 first fastening portion
60 second fastening portion
62 first-side stay
64 second-side stay
66 first-side overlapping portion
68 second-side overlapping portion
70 fastening portion

The invention claimed is:

1. A reactor-securing structure comprising:

a reactor including a core member having a coil wound thereon; and a first-side stay and a second-side stay, the first-side stay and the second-side stay fixing the reactor to a case, wherein one end portions of the first-side stay and the second-side stay are coupled to portions of the reactor shifted toward respective sides of a coil in the axial direction thereof, the other end portion of the first-side stay and the other end portion of the second-side stay are fastened and coupled to the case in a state of overlapping each other directly or via another member, the other end portion of the first-side stay overlaps an opponent member to constitute a first-side overlapping portion, the other end portion of the second-side stay overlaps an opponent member to constitute a second-side overlapping portion, at least parts of the first-side overlapping portion and the second-side overlapping portion when viewed in a direction orthogonal to overlapping surfaces of the first-side overlapping portion and the second-side overlapping portion are provided within the same range in the longitudinal direction of the I-shaped portion which forms the core member and the coil is wound on, and the first fastening portion which couples the first-side overlapping portion and the case is provided on one-end coupling side of the second-side stay with respect to the second fastening portion which couples the second-side overlapping portion and the case in the longitudinal direction of the I-shaped portion which constitutes the core member.

2. A reactor-securing structure comprising:

a reactor including a core member having a coil wound thereon; and a first-side stay and a second-side stay, the first-side stay and the second-side stay fixing the reactor to a case, wherein one end portions of the first-side stay and the second-side stay are coupled to portions of the reactor shifted toward respective sides of a coil in the axial direction thereof, the other end portion of the first-side stay and the other end portion of the second-side stay are fastened and coupled to the case in a state of overlapping each other directly or via another member, the other end portion of the first-side stay overlaps an opponent member to constitute a first-side overlapping portion, the other end portion of the second-side stay overlaps an opponent member to constitute a second-side overlapping portion, at least parts of the first-side overlapping portion and the second-side overlapping portion when viewed in a direction orthogonal to overlapping surfaces of the first-side overlapping portion and the second-side overlapping portion are provided within the same range in the longitudinal direction of the I-shaped portion which forms the core member and the coil is wound on, and a first fastening portion which couples the first-side overlapping portion and the case and a second fastening portion which couples the second-side overlapping portion and the case are formed by a common fastening portion.

3. The reactor-securing structure according to claim 1, wherein the case is an inverter case configured to store and fix an inverter and the reactor therein.

4. The reactor-securing structure according to claim 2, wherein the case is an inverter case configured to store and fix an inverter and the reactor therein.

* * * * *